US009781527B2

(12) United States Patent
Zaman

(10) Patent No.: US 9,781,527 B2
(45) Date of Patent: Oct. 3, 2017

(54) SMART PLUG AND PLAY AUTOMATIC OBD-II SYSTEM TESTER

(71) Applicant: Panasonic Automotive Systems Company of America, Division of Panasonic Corporation of North America, Peachtree City, GA (US)

(72) Inventor: Najamuz Zaman, Westland, MI (US)

(73) Assignee: Panasonic Automotive Systems Company of America, Division of Panasonic Corporation of North America, Peachtree City, CA (US)

( * ) Notice: Subject to any disclaimer, the term of this patent is extended or adjusted under 35 U.S.C. 154(b) by 38 days.

(21) Appl. No.: 14/845,685

(22) Filed: Sep. 4, 2015

(65) Prior Publication Data

US 2016/0073211 A1 Mar. 10, 2016

Related U.S. Application Data

(60) Provisional application No. 62/047,832, filed on Sep. 9, 2014.

(51) Int. Cl.
*H04R 29/00* (2006.01)

(52) U.S. Cl.
CPC ..... *H04R 29/00* (2013.01); *H04R 2499/13* (2013.01)

(58) Field of Classification Search
CPC .. H04R 2499/13; H04R 29/001; H04R 29/00; H04R 29/002; H04R 3/00; H04R 1/025; H04R 2420/05; H04R 2430/00; H04R 25/453; H04R 27/00; H04R 29/005; H04R 29/007; H04R 3/002; H04R 3/007; H04R 5/027; H04R 1/2803; H04R 1/1008; H04R 1/1041; H04R 2420/01; H04R 2420/07; H04R 5/033; H04R 5/04
USPC .. 381/86, 58, 59, 103, 56, 98, 106, 107, 55, 381/71.4, 94.1, 99, 104, 150, 18, 20, 300, 381/303, 307, 314, 77, 80, 96, 71.5, 81
See application file for complete search history.

(56) References Cited

U.S. PATENT DOCUMENTS 4,924,398 A * 5/1990 Fujiwara ..... G01B 31/31850 701/114
5,361,305 A 11/1994 Easley et al.
5,815,584 A * 9/1998 Whitecar ..... G01R 31/007 381/59
2001/0012243 A1 * 8/2001 Hasegawa ..... G01D 3/08 369/6
2003/0120367 A1 6/2003 Chang et al.
2003/0236601 A1 12/2003 McLeod et al.
2003/0236672 A1 12/2003 Aaron et al.
2008/0059019 A1 * 3/2008 Delia ..... G07C 5/085 701/33.4

(Continued)

OTHER PUBLICATIONS

International Search Report and the Written Opinion, Nov. 5, 2015, pp. 1-7, International Searching Authority, U. S., Alexandra, VA USA.

*Primary Examiner* — Akelaw Teshale
(74) *Attorney, Agent, or Firm* — Laurence S. Roach, Esq.

(57) ABSTRACT

An audio system testing arrangement includes a controller coupled to a communication. bus of a motor vehicle. The controller runs test scripts via the communication bus. The test scripts are for testing features of an audio system within the vehicle. A fault of the audio system is determined dependent upon results of the test scripts, a display and/or speaker annunciates the determined fault of the audio system.

17 Claims, 2 Drawing Sheets

(56) References Cited

U.S. PATENT DOCUMENTS

| | | | | |
|---|---|---|---|---|
| 2009/0177354 | A1* | 7/2009 | Agrawal | G01M 17/007 701/33.4 |
| 2011/0029196 | A1 | 2/2011 | Escott | |
| 2013/0207665 | A1* | 8/2013 | Bandyopadhyay | G01R 31/02 324/537 |
| 2013/0243204 | A1 | 9/2013 | Kao et al. | |
| 2013/0294609 | A1* | 11/2013 | Tackett | H04R 29/007 381/56 |

* cited by examiner

SMART PLUG AND PLAY AUTOMATIC OBD-II SYSTEM TESTER

CROSS-REFERENCE TO RELATED APPLICATIONS

This application claims the benefit of U.S. Provisional Application No. 62/047,832, filed on Sep. 9, 2014, which the disclosure of which is hereby incorporated by reference in its entirety for all purposes.

BACKGROUND OF THE INVENTION

1. Field of the Invention

The present invention relates to a system for automatically testing an automotive audio system.

2. Description of the Related Art

Level I repair in automotive electronics systems has often caused unnecessary removal of vehicle components resulting in loss of time and money and repair facilities carrying an excessive inventory of replacement parts. "Level I repair" refers to making the system operational by removing a faulty module. "Level II repair" refers to making the module operational by repairing the electronics embedded inside the module.

The OEM dealerships currently use a computer and a vehicle signal bus interface (e.g., a CAN interface) which plugs directly onto the vehicle OBD-II connector where the operator reads the diagnostics trouble code (DTC) to ascertain the defects in the audio system. The DTC's read-out procedure with few internal limited self-tests by the current system is the only feature available for the dealership. The method being used today is not very beneficial to OEMs because a large number of audio system removals have proven to be unjustified and unneeded.

Vehicle dealerships and repair shops across North America may utilize the OBD-II standard when troubleshooting or repairing a vehicle and its electronic systems. Generally, the OBD-II standard specifies the type of diagnostic connector used to connect a computer to the vehicle's onboard computer systems in order to troubleshoot those systems. The OBD-II standard also specifies the pinout of the connector, the electronic signal protocols, and the messaging format and diagnostic trouble codes (DTCs) by which the statuses of vehicle systems are indicated. As a result of this standardization, a single device can query many of the on-board computer(s) in any OBD-II-equipped vehicle. However, the procedures and trouble-shooting methods used often generate inaccurate diagnostic information that can result in unnecessary repairs.

SUMMARY OF THE INVENTION

The smart plug and play automatic on-board diagnostic (OBD) II tester of the present invention may avoid the unjustified removals of OEM's system components. The invention may include an embedded controller with a user display that plugs into the OBD-II connector, where the controller may run a pre-programmed suite of test scripts to detect and identify faults in the vehicle electronics systems, and particularly in the audio system. This is advantageous over the current situation where unjustified removals are causing high maintenance costs due to misdiagnosis by the dealerships. The present invention may take advantage of the microprocessor included in many of today's audio systems to communicate diagnostic information between the tester and the audio system.

Known diagnostic tools for audio systems may merely perform ON/OFF tests to determine whether the radio is working or not working. The present invention, in contrast, may verify individual subsystems and individual functions of the radio and other components of the audio system.

The invention may take advantage of an in-cabin microphone and a temperature sensor within the audio system housing to test the various subsystems and features of the audio system. The temperature sensor may provide useful information because low temperatures may be a cause of audio system failures.

The smart plug and play automatic OBD-II system tester may run the series of test scripts by invoking the diagnostics features of each and every module on the bus in order to identify the hard failure in the system. The tester may then propose to the user a positive identification of the failed component(s) to remove.

The smart plug and play automatic OBD-II system tester may show on the display a failure code, or the actual name of the part directly linked to the failure. This may justify or not justify the Level I repair and identify which specific part needs to be removed and replaced, if any. Thus, in the long run the inventive tester may reduce the costs of maintenance, repair, supply-chain, post-removal diagnostics, and in depth-analysis.

The smart plug and play automatic OBD-II system tester may not require any computer, or complex procedures to use the device. The inventive tester may merely call for plugging the device to the current OBD-II connector that is available globally in OEM's vehicles.

The smart plug and play automatic OBD-II system tester may not depend on human intelligence to identify the fault. Rather, the tester may run the series of test scripts by utilizing an intelligent algorithm, and may then determine the system faults. No such device exists today to help troubleshoot the vehicle electronics system. The inventive device may be extremely helpful to the automobile dealership, especially those dealerships that do not have the qualified manpower and resources to accurately diagnose failures.

The invention comprises, in one form thereof, an audio system testing arrangement including a controller coupled to a communication bus of a motor vehicle. The controller runs test scripts via the communication bus. The test scripts are for testing features of an audio system within the vehicle. A fault of the audio system is determined dependent upon results of the test scripts, a display and/or speaker annunciates the determined fault of the audio system.

The invention comprises, in another form thereof, an audio system testing method, including coupling a controller to a communication bus of a motor vehicle. The controller is used to run a plurality of test scripts via the communication bus. The test scripts test features of an audio system within the vehicle. A fault of the audio system is determined dependent upon results of the test scripts. The determined fault of the audio system is annunciated by a speaker and/or display screen.

The invention comprises, in yet another form thereof, an audio system testing arrangement including a controller running a plurality of test scripts via a communication bus of a motor vehicle. The test scripts include a plurality of first test scripts that store information about an audio system of the vehicle and a plurality of second test scripts that diagnose the audio system. The controller determines a fault of the audio system dependent upon results of the test scripts. A display and/or speaker annunciates the determined fault of the audio system.

Advantages of the present invention are that it simplifies the troubleshooting of the system, shortens the time to repair, identifies the faulty components, and reduces the number of overall unjustified component removals.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

DETAILED DESCRIPTION

Glossary

Test script—a set of instructions to be performed on a system under test to verify that the system functions properly.

Communication bus—a communication system that transfers data and signals between components inside a computing device, or between computing devices.

The embodiments hereinafter disclosed are not intended to be exhaustive or limit the invention to the precise forms disclosed in the following description. Rather the embodiments are chosen and described so that others skilled in the art may utilize its teachings.

Figure 1:
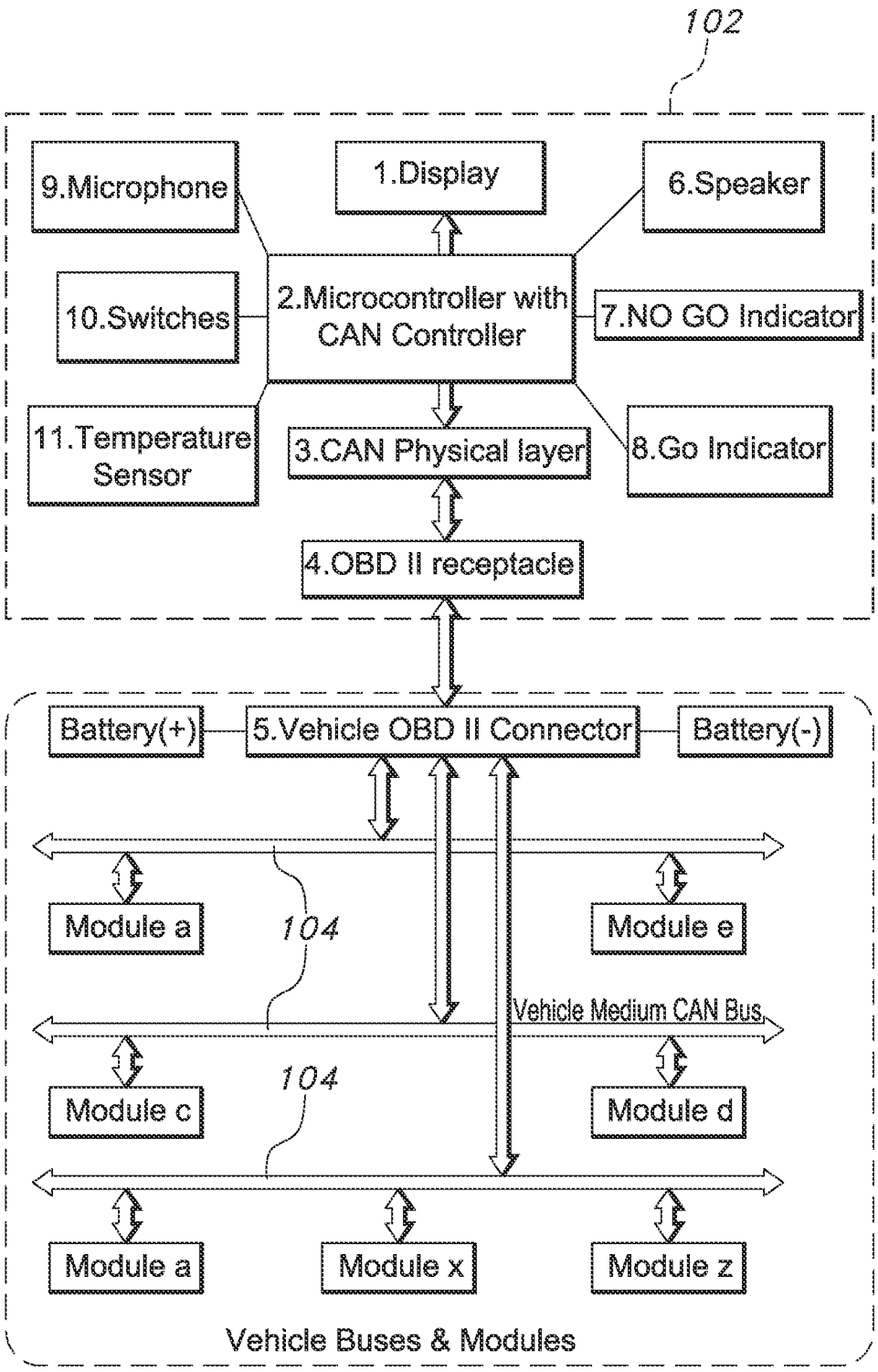
FIG. 1 is a block diagram of one embodiment of a plug and play automatic OBD-II system tester arrangement of the present invention.

FIG. 1 illustrates one embodiment of a plug and play automatic OBD-II system tester arrangement of the present invention suited for the particular example of a CAN type vehicle signal bus. However, it is to be understood and appreciated by those of skill in the art that the invention may be equally applicable to other types of vehicle signal buses. The following is a list of components of the tester arrangement:

1. Block 1: alphanumeric display used to show test sequences, statuses & codes
2. Block 2: microcontroller supporting vehicle CAN bus message connectivity
3. Block 3: CAN physical layer, industry standard CAN integrated chip
4. Block 4: tester OBD-II receptacle or mating to mate with the vehicle communication bus, battery and ground (GND)
5. Block 5: vehicle OBD-II connector mounted inside the vehicle
6. Block 6: speaker for beeps, chimes or human-voice announcements
7. Block 7: "NO-GO" lamp indicating system fault
8. Block 8: "GO" lamp indicating no faults
9. Block 9: microphone listening to left front driver-side speaker to check sound
10. Block 10: switches to forward or backward the test sequences
11. Block 11: temperature sensor inside the cabin to monitor ambient test conditions Components in blocks 1-4 and 6-11 may be included in plug and play automatic OBD-II system tester 102.

In an operation procedure during use, the user may plug in the inventive plug and play automatic OBD-II system tester 102 to the vehicle OBD-II connector 5.

Tester 102 may perform the initial tests and establish the communication link with the vehicle communication bus 104.

Tester 102 may initiate the testing and perform the testing as per the defined test script meant to test and isolate the defect by testing each and every module.

Tester 102 may execute the diagnostics and troubleshooting of each module.

Tester 102 may use the on-board temperature sensor to log the ambient temperature, date and time stamp.

Tester 102 may listen to the sound using the microphone to take logical decisions based on a sound comparator circuit mounted inside the tester 102.

Tester 102 may generate beeps, chimes and announcements to assist troubleshooting.

Tester 102 may turn ON a 'GO' green LED if all the systems are fine and operating correctly.

Tester 102 may turn ON a "NO GO' Red LED if any fault is detected.

The inventive smart plug and play automatic OBD-II system tester 102 may rectify the current state of affairs at the dealership, which faces serious technical challenges due to advanced vehicle electronics architecture. The inventive plug and play automatic OBD-II system tester 102 may be used at the dealership, but may also be used when the vehicle is being developed as a benchmark for success. The inventive plug and play automatic OBD-II system tester 102 may find the faults in the audio system and shift the burden from the human user to the tester.

The features of plug and play functionality are not offered today by any other equipment in use by dealerships across the board. The inventive plug and play automatic OBD-II system tester 102 is intelligent and runs the system test script to find the issues, unlike the current mechanism of in-vehicle testing, where self-tests have limited exposure to the entire chain of vehicle electronics system. Plug and play automatic OBD-II system tester 102 executes embedded test scripts.

The self-contained embedded controller, a microphone, a small speaker and CAN bus connectivity to the vehicle systems may automatically begin testing once tester 102 is plugged onto the vehicle OBD-II connector 5. Tester 102 may run the tests sequence and display the pass/fail results immediately after the test. The pass/fail display may be augmented by the failed test identification code. Each failed test identity code is associated with the failed component(s). After the test script is executed and complete, a positive identity of the failed component(s) is determined and the failed component identity is revealed on the display.

Figure 2:
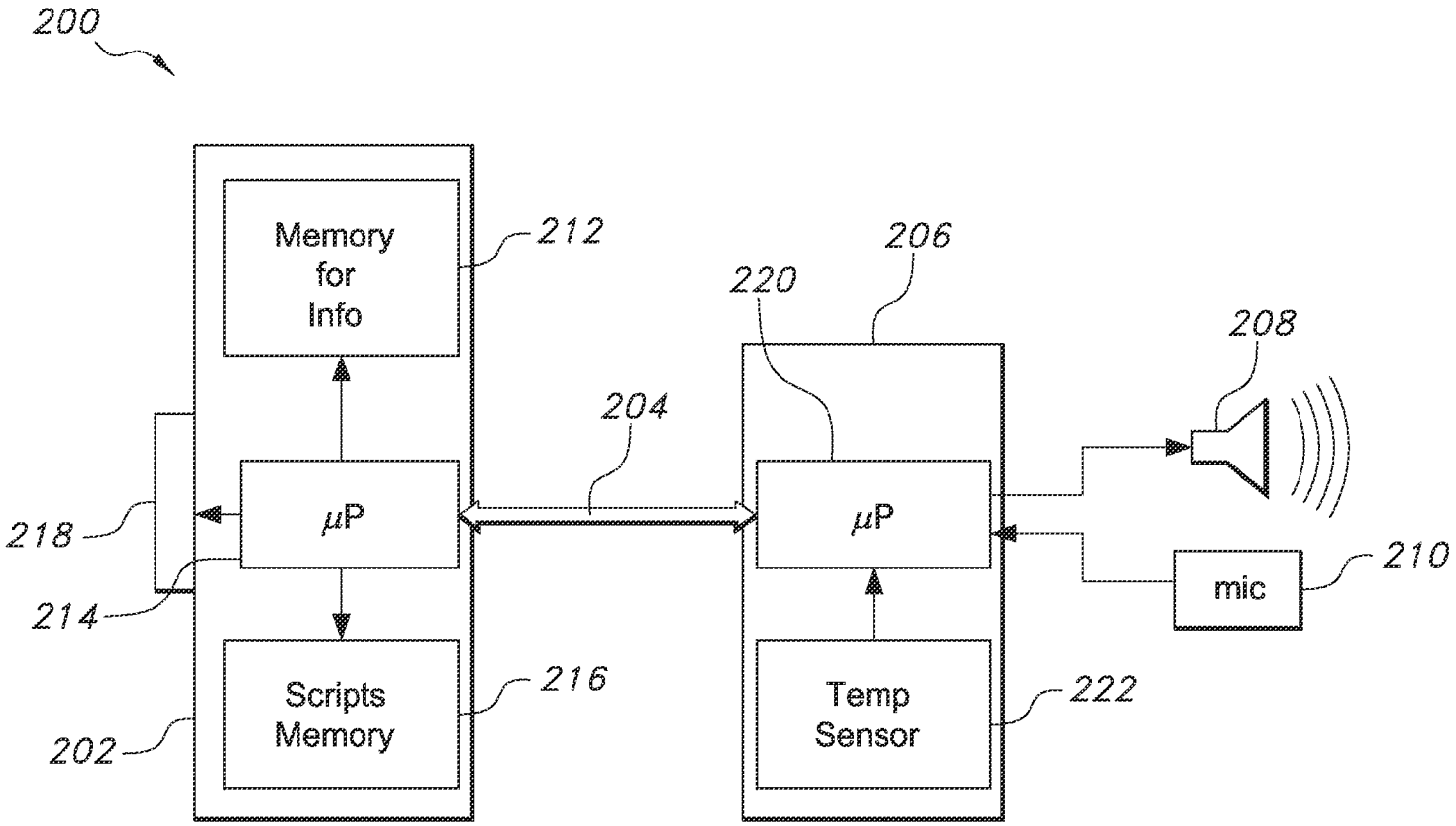
FIG. 2 is a block diagram of an other embodiment of a plug and play automatic OBD-II system tester arrangement of the present invention.

FIG. 2 illustrates one embodiment of a plug and play automatic OBD-II system tester arrangement 200 of the present invention, including a tester 202, a communication bus 204, an audio system 206, a loudspeaker 208 and a microphone 210. Tester 202 includes a memory 212 for storing information, an electronic processor 214, a memory 216 for storing scripts, and a display 218. Processor 214 is communicatively coupled to each of memory 212, memory 216 and display 218.

Audio system 206 includes an electronic processor 220 and a temperature sensor 222. Audio system processor 220 is communicatively coupled to tester processor 214 via bus 204. Audio system processor 220 receives temperature data from temperature sensor 222 and an audio signal from microphone 210. Audio system processor 220 also transmits another audio signal to speaker 208.

During use, tester processor 214 transmits signals to speaker 208 and receives signals from microphone 210 through bus 204 and audio system processor 220. Other features of automatic OBD-II system tester arrangement 200 may be substantially similar to the features of the automatic OBD-II system tester arrangement of FIG. 1, and are omitted herein in order to avoid needless repetition.

Test Scripts may be divided into partitions and each partition is responsible for the tasks that are executed to reach a positive conclusion for that particular scope of testing.

Test scripts modules are listed below:

Test & Verify—Test Script 1—Battery Integrity—Store Information

This test may check the battery voltage at the time of test to establish the operational envelope of the module which is under test, and which is installed in the vehicle. The test is called for because if the battery voltage is below 9V or greater than 16V then the testing is not valid and so the testing must not begin or if it has already begun, it must be stopped. In any scenario the battery voltage may be measured and stored by the test script to enable the customer to review the information.

Test & Verify—Test Script 2—CAN Bus Terminations—Store Information

The CAN bus integrity is extremely useful to know before the testing is commenced. The bus voltages of CAN-Hi and CAN-Lo may be measured to determine whether the terminations are correct. The CAN-Hi and CAN-Lo are industry standard values. The CAN read outs may be stored by the test script to enable the customer to review the information.

Test & Verify—Test Script 3—CAN Bus Integrity—Store Information

Similar to test script 2, but a test message is sent to the unit under test to determine whether the communication bus integrity is true and intact.

Test & Verify—Test Script 4—Module Turn-On Message—Store Information

The test sequence sends a series of commands to turn on the unit under test. If the unit under test is already on then it verifies the bus messages meant for the unit under test (UUT). The test script stores the information as recorded data.

Test & Verify—Test Script 5—Ignition Switch Positions—Store Information

The test sequence verifies the ignition switch position to determine the module operational features, so that it could run relevant feature test for that ignition switch position.

Test & Verify—Test Script 6—All Components are Active on the Bus

The test sequence talks to all audio components on the bus to make sure that system is ready and operational to perform the next test necessary for the operation of the unit under test.

Test & Verify—Test Script 7—Radio Nomenclature—Store Information

The test sequence reads the radio nomenclature, part number and stores that information. The test sequence can then calculate the manufacturing location.

Test & Verify—Test Script 8—Radio DTCs—Store Information

The test sequence requests the radio (UUT) to deliver the diagnostics information if there is an error condition detected by the radio (UUT) operational software. If there is a fatal error stored, the test script will determine the next courses of action, such as whether to continue to test or stop.

Test & Verify—Test Script 9—Audio Functions

The test sequence verifies the audio functions of the radio by playing a test CD, tuning to a station, or by selecting the audio input jack connected to a smart phone. The microphone listens to sound to verify the audio functions.

Test & Verify—Test Script 10—Radio Functions

The test sequence verifies the Radio frequency functions of the radio, such as tuning to stations, seek and stop.

Test & Verify—Test Script 11—Display Integrity

The test sequence verifies that the display shows the relevant information and, if the display is on the vehicle communication bus, then the bus messages between the display and the radio may be verified.

Test & Verify—Test Script 12—Steering Control Switches

The test sequence reads the steering wheel control switches to manage the radio testing, and verifies whether the switch contacts are functioning correctly.

Test & Verify—Test Script 13—Instrument Cluster Integrity

The test script verifies the connectivity to the instrument cluster to confirm that the module is active on the bus, which consequently confirms operational integrity of the instrument cluster.

Test & Verify—Test Script 14—Radio Knobs and Switches

The test script checks the volume knob, seek/stop, eject and many other switches to verify the operational integrity of the switches.

Test & Verify—Test Script 15—Chimes Functions

The test script verifies the operational integrity of the chimes by playing each chime and "listening" through the microphone.

Test & Verify—Test Script 16—Active Noise Cancellation Functions

The test script send commands to an active noise cancellation module to confirm that the active cancellation is functioning correctly.

Test & Verify—Test Script 17—Engine Sound Enhancement Functions

The test script sends commands to execute engine sound enhancement sounds and "listens" through the microphone to confirm or reject the functional capability of engine sound enhancement.

Test & Verify—Test Script 18—External Amplifier Functions

If the external amplifier is connected to the radio, then the test script verifies the operational performance of the external amplifier by sending the test commands or by re-running the test script 9 and test script 10 listed above.

Test & Verify—Test Script 19—Instrument Cluster Functions Related to Audio Chimes If there are functions related to audio embedded in the instrument cluster, then the test script continues to perform tests by sending commands to the instrument cluster and then listening to audio beeps, chimes or tones through the microphone.

Test & Verify—Test Script 20—'X" Module Functions

The testing could continue to test other modules on the bus relevant to audio system integrity, like a gateway module, or a separate display.

Test & Verify—Test Script 21—'Y' Module Functions

The testing could continue to test other indirect modules, sending information critical for the audio system.

Test & Verify—Test Script 22—'Z' Module Functions

The testing could continue to talk to a separate switching and knob panel to confirm that the module integrity is not compromised.

It is possible within the scope of this invention to test and verify each and every module on the bus irrespective of their fit, form and functions.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An audio system testing arrangement, comprising: a controller configured to:

be coupled to a communication bus of a motor vehicle;

run a plurality of test scripts via the communication bus, the test scripts testing features of an audio system within the vehicle; and determine a fault of the audio system dependent upon results of the test scripts;

a display and/or speaker configured to annunciate the determined fault of the audio system;

a microphone configured to sense audible sounds emitted by a speaker of the vehicle, the controller being configured to determine the fault of the audio system dependent upon a signal generated by the microphone; and a first switch connected to the controller and a second switch connected to the controller, the first switch configured to cause the controller to run a next one of said test scripts in response to the first switch being actuated, the second switch being configured to cause the controller to run a previous one of said test scripts in response to the second switch being actuated.

2. The arrangement of claim 1 further comprising a temperature sensor configured to sense a temperature of the audio system, the controller being configured to determine the fault of the audio system dependent upon a signal generated by the temperature sensor.

3. The arrangement of claim 2 wherein the signal generated by the temperature sensor includes a temperature and a date and time stamp associated with the temperature.

4. The arrangement of claim 1 wherein the test scripts include a plurality of first test scripts that store information about an audio system of the vehicle and a plurality of second test scripts that diagnose the audio system, the stored information including a battery voltage.

5. The arrangement of claim 1 wherein the controller is disposed within a portable module that is configured to be temporarily plugged into the motor vehicle.

6. An audio system testing method, comprising the steps of:

coupling a controller to a signal bus of a motor vehicle;

using the controller to run a plurality of test scripts via the signal bus, the test scripts testing features of an audio system within the vehicle;

determining a fault of the audio system dependent upon results of the test scripts;

annunciating the determined fault of the audio system sensing a temperature of the audio system;

determining the fault of the audio system dependent upon the sensed temperature; and generating and storing in memory a date and time stamp in association with the temperature;

causing the controller to run a next said test script by actuating a first switch; and causing the controller to run a previous said test script by actuating a second switch.

7. The method of claim 6 wherein the determined fault is annunciated by a display screen and/or a loudspeaker.

8. The method of claim 6 further comprising:

sensing audible sounds emitted by a speaker of the vehicle; and determining the fault of the audio system dependent upon the sensed audible sounds.

9. The method of claim 8 wherein the sensing of audible sounds is performed by a microphone, and the fault of the audio system is determined dependent upon a microphone signal generated by the microphone.

10. The method of claim 6 wherein the test scripts include a plurality of first test scripts that store information about an audio system of the vehicle and a plurality of second test scripts that diagnose the audio system, the stored information including a radio nomenclature and part number.

11. The method of claim 6 wherein the controller is disposed within a portable module, the method further comprising temporarily plugging the portable module into the motor vehicle.

12. An audio system testing arrangement, comprising: a controller configured to:

run a plurality of test scripts via a communication bus of a motor vehicle, the test scripts including a plurality of first test scripts that store information about an audio system of the vehicle and a plurality of second test scripts that diagnose the audio system, the stored information including at least one of a battery voltage, a radio nomenclature and a radio part number; and determine a fault of the audio system dependent upon results of the test scripts; and a display and/or speaker configured to annunciate the determined fault of the audio system; and a first switch connected to the controller and a second switch connected to the controller, the first switch being configured to cause the controller to run a next one of said test scripts in response to the first switch being actuated, the second switch being configured to cause the controller to run a previous one of said test scripts in response to the second switch being actuated.

13. The arrangement of claim 12 further comprising a microphone configured to sense audible sounds emitted by a speaker of the vehicle, the controller being configured to determine the fault of the audio system dependent upon a signal generated by the microphone.

14. The arrangement of claim 13 further comprising a temperature sensor configured to sense a temperature of the audio system, the controller being configured to determine the fault of the audio system dependent upon a signal generated by the temperature sensor.

15. The arrangement of claim 14 wherein the signal generated by the temperature sensor includes a temperature and a date and time stamp associated with the temperature.

16. The arrangement of claim 12 wherein the controller is disposed within a portable module that is configured to be temporarily plugged into the motor vehicle.

17. The arrangement of claim 12 wherein the stored information includes a battery voltage, a radio nomenclature and a radio part number.

* * * * *